US005929355A

United States Patent [19]

Adinolfi

[11] Patent Number: 5,929,355

[45] Date of Patent: Jul. 27, 1999

[54] INTEGRATED SUPPORT AND ELECTRONIC PREWIRED RACK FOR ACOUSTIC DRUMS WITH ELECTRONIC TRIGGER SENSOR

[76] Inventor: Alfonso M. Adinolfi, 607-18th Ave. East, Seattle, Wash. 98112

[21] Appl. No.: 09/013,804

[22] Filed: Jan. 26, 1998

[51] Int. Cl.[6] ..... G10D 13/02

[52] U.S. Cl. ..... 84/421; 84/327

[58] Field of Search ..... 84/421, 327, 387 A

[56] References Cited

U.S. PATENT DOCUMENTS

| | | | |
|---|---|---|---|
| 4,227,049 | 10/1980 | Thomson et al. | 179/1 M |
| 4,691,611 | 9/1987 | May | 84/421 |
| 5,063,821 | 11/1991 | Battle | 84/723 |
| 5,140,889 | 8/1992 | Segan et al. | 84/723 |
| 5,161,761 | 11/1992 | May | 248/122 |
| 5,337,646 | 8/1994 | Austin | 84/421 |
| 5,520,292 | 5/1996 | Lombardi | 211/13 |
| 5,531,148 | 7/1996 | Wilson | 84/412 |
| 5,726,369 | 3/1998 | Gilday | 84/327 |

*Primary Examiner*—William M. Shoop, Jr.
*Assistant Examiner*—Shih-yung Hsieh
*Attorney, Agent, or Firm*—Graybeal Jackson Haley LLP

[57] ABSTRACT

An integrated support and wired rack system is provided for acoustic-electronic and or electronic percussion instruments in which tubular cross and upright support members form a free standing rack with each tubular section carrying bundled wires inside the support and input and output jacks and connectors mounted on the rack at strategic locations adjacent the drum placement mounts and having cross to upright jumper cables and connectors to allow for the height and width adjustments of the integrated rack system.

7 Claims, 3 Drawing Sheets

INTEGRATED SUPPORT AND ELECTRONIC PREWIRED RACK FOR ACOUSTIC DRUMS WITH ELECTRONIC TRIGGER SENSOR

FIELD OF THE INVENTION

The invention relates to racks for supporting a set of percussion musical instruments and in particular to a rack system for acoustic drums at least some of which are equipped with sensors capable of triggering an electronic device.

BACKGROUND OF INVENTION

Following the success of electric keyboards and guitars, innovators have created the electronic counterparts of other acoustic instruments, including drums.

In providing the electronic counterpart of acoustical drums, small circular resilient pads are often used to convert the strike of the player's drumsticks into electronic impulses that are in turn converted into synthesized drumlike sounds. These electronic drum pads represent one kind of electronic percussion instrument for creating the synthesized drum sounds. While electronic percussion instruments have the advantage of controlled output and the ability to produce a wide variety of sounds, they do not play the same as an acoustic drum. some performers and less than optimum for others. The disadvantages are primarily in the feel of the sticks as they strike the simulated drum surface and, in the drummer's motor memory in reaching for the usual placement and strike area of conventional acoustic sets.

In order to try and solve the problems associated with the feel of electric drums innovators have proposed use of acoustic drums equipped with electronic sensors as the triggering mechanism for a drum synthesizer. An example of a drum with an electronic sensor is found in U.S. Pat. No. 5,593,000. As with acoustic drums, electronic and combination electronic-acoustic instruments are played most commonly in a set such as a tom, snare and base. Other percussion instruments having electronic signal output may accompany the stand drum set. The drum set is held on a rack that supports the devices within comfortable playing distance to the sitting or standing musician. When the instruments are of the electronic output kind the set is encumbered by rats nest of wires and cables that drape off the rack or stand and connect to the amplifier synthesizer console. The assembly is a mess and the wiring will often interfere with the players performance.

SUMMARY OF THE INVENTION

There is need for a support rack or stand having the capability of accommodating the newer electronic output drums especially those which may be used as either an electric or acoustic instrument with the ability to change function on demand.

Thus, in accordance with the preferred embodiment of the invention, an integrated support and wired rack system is provided for acoustic-electronic and or electronic percussion instruments in which tubular cross and upright support members form a free standing rack with each tubular section carrying bundled wires inside the support and input and output jacks and connectors mounted on the rack at strategic locations adjacent the drum placement mounts and having cross to upright jumper cables and connectors to allow for the height and width adjustments of the integrated rack system. The internal wires lead from the input jacks to a multi-pin connector positioned on the rack near its feet so that a multi-instrument cable is neatly run from one connector to the electronic console.

The components and operation of the integrated drum rack system provide an easily manufactured, readily reparable, reliable musical set up that combines the advantage of having an acoustic drum set stand with the ability of accommodating electronic instruments in a prewired support rack with wires and cables safely and neatly hidden. The invention is applicable to standard types and sizes of drums and other percussion instruments, including snare, bass and tom, as well as custom sizes.

These and further features, objects and advantages of the invention will become apparent to those skilled in the art from the following detailed description and dependent drawings.

DETAILED DESCRIPTION OF THE INVENTION

Figure 1:
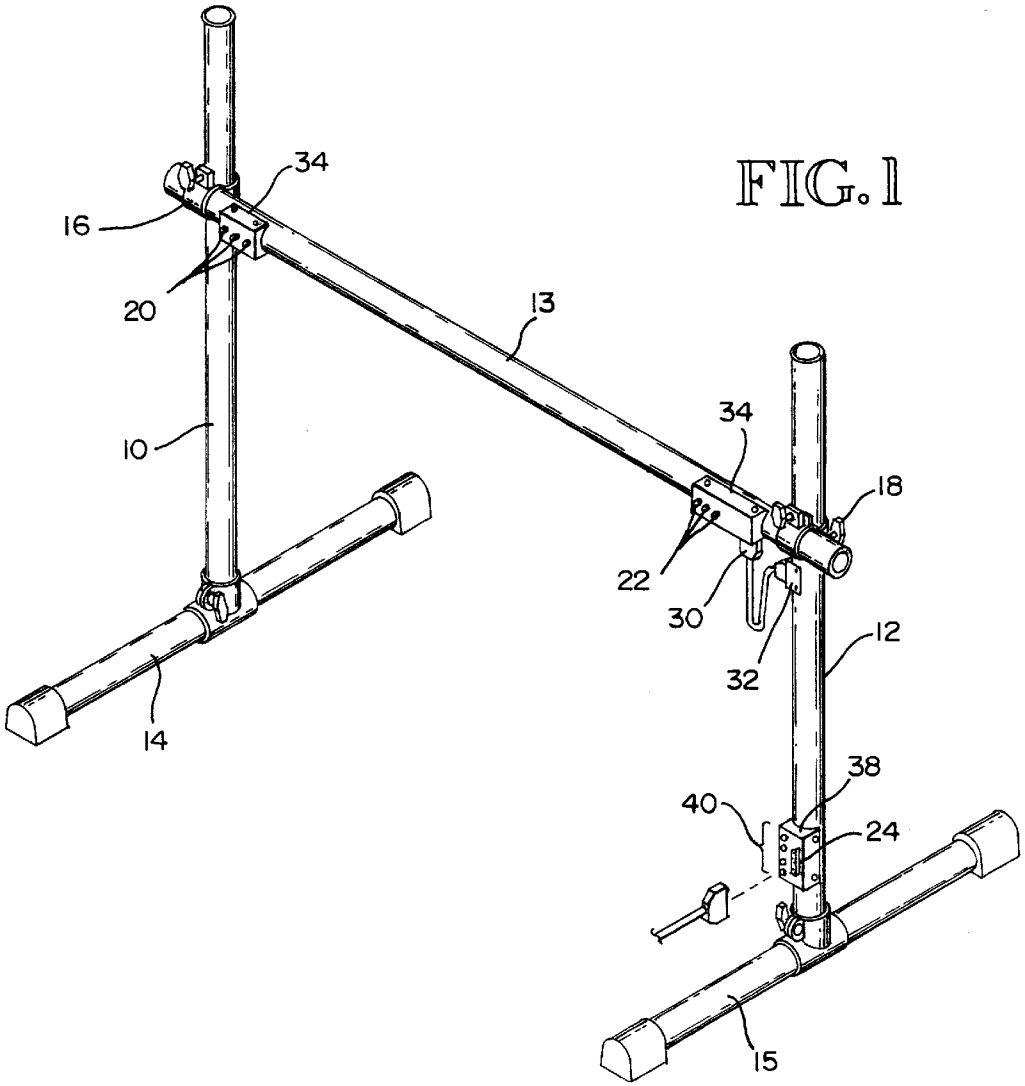
FIG. 1 is an isometric view of the integrated rack system of one embodiment of the present invention showing the external appearance of the support tubular members without mounted instruments and illustrating the input jacks and output connector for the electronic sound to electrical trigger wiring.

An integrated support and wired rack for electronic percussion instruments is shown in FIG. 1 to have first and second tubular upright supports 10 and 12 each having feet 14 and 15 respectively adapted to be placed on a floor at spaced positions. On these uprights a tubular horizontal cross support 13 is mounted so as to extend therebetween at an above floor position for mounting drums or other instruments in a set assembled for the player. The rack needs to be adjustable for the individual requirements of the musician.

For this reasons first and second right angle clamps 16 and 18 are fitted to the round circumference on said upright and cross supports 10,12 and 13 for adjustably mounting said cross support in the above floor position. The clamps are per se conventional and allow the tubular supports to be slipped when the clamps are loosened to a desired position and then the clamps 16 and 18 are tightened on both the cross support and each upright support.

Figure 3:
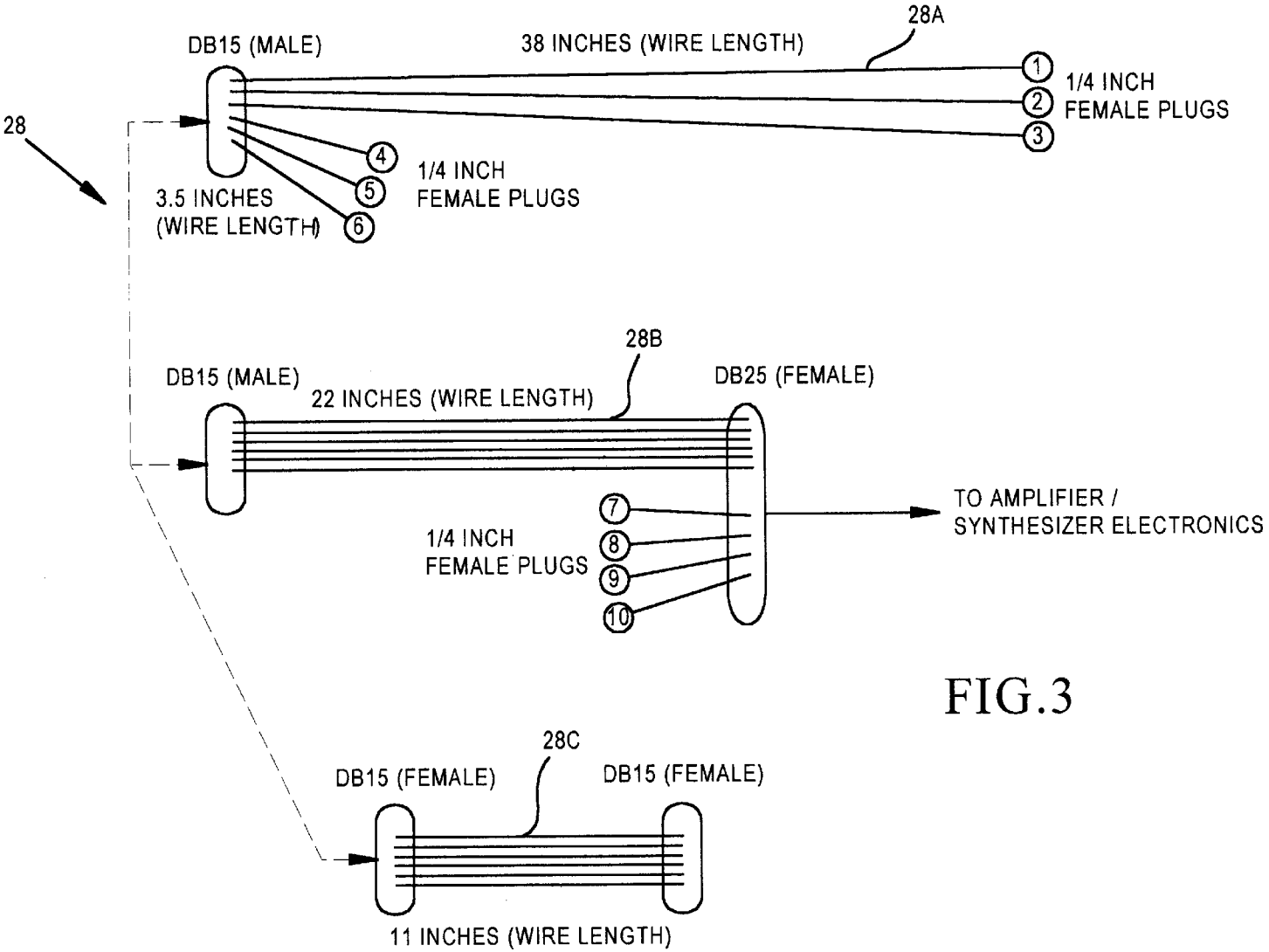
FIG. 3 is a wiring diagram of the hidden wires harnesses and exposed jacks and multi-pin connectors of the rack system of FIG. 1.

Electrical input rack jacks 20 and 22 are mounted on said cross support for receiving mating connectors of the phone plug type for conducting output signals of instruments supported on said cross support or upright supports to an internal wire harness shown in FIG. 3.

An electrical output connector 24 of the multi-pin type such as a DB 25 is mounted on at least one of said upright supports, here support 12, below said cross support 13 for connection to electronic signal amplifying equipment, not shown.

A wiring harness 28 having separate segments 28*a*, 28*b* and 28*c* and containing wires to service each input phone jack is inserted substantially inside the tubular supports and extends to output connector 24. The segment 28*c* is a short jumper with multi-pin connectors 30 on each end in order to extend the wire harness around the tube support clamps. For this purpose mating connectors 32 are mounted on brackets located on the supports adjacent the clamps. The jumper 28*c* is of a length sufficient to allow the cross support to be raised and lowered to suit the musician.

Figure 2:
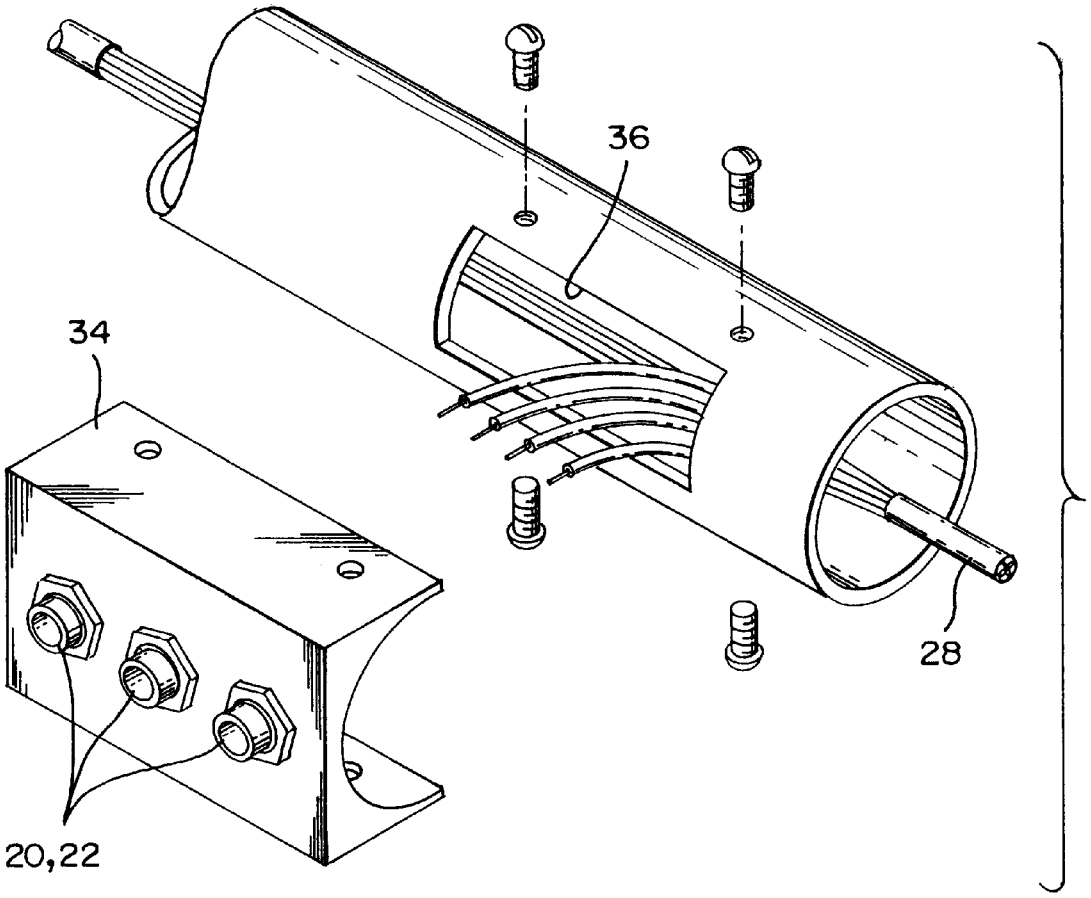
FIG. 2 is an enlarged sectional view illustrating the sound-to-electrical trigger wiring and input jacks for the cross bar support.

Jack brackets 34 are mounted with fasteners on an exterior of cross support 13 adjacent opposite ends and have a plurality of input jacks of the female phone type installed thereon as shown in FIG. 2. An opening 36 is formed in a wall of said tubular cross support in registration with each jack bracket 34 through which wires pass from said wiring harness to input jacks 20 and 22.

A combined input output connector bracket 38 is mounted on an exterior of said at least one upright support adjacent its foot, and bracket 38 is provided with additional plurality of instrument input jacks 40 also of the female phone type along with the multi-pin output connector 24 so as to receive inputs from instruments mounted on or near the floor as in the case of base drums.

A standard ¼" audio jack assembly is suitable for the input jacks. However any suitable input jack type can be used.

While only particular embodiments have been disclosed herein, it will be readily apparent to persons skilled in the art that numerous changes and modifications can be made thereto, including the use of equivalent means, devices and methods, without departing from the spirit of the invention.

I claim:

1. An integrated support and wired rack for electronic percussion instruments, comprising:

first and second tubular upright supports each having feet adapted to be placed on a floor at spaced positions;

a tubular horizontal cross support extending between said upright supports at an above floor position;

first and second right angle clamps fitted to said upright and cross supports for adjustably mounting said cross support in the above floor position;

electrical input rack jacks mounted on said cross support for receiving mating connectors conducting output signals of instruments supported on said cross support or upright supports;

electrical output connector mounted on at least one of said upright supports below said cross support for connection to electronic signal amplifying equipment; and a wiring harness having wires disposed substantially inside said supports and extending between said input rack jacks and said output connector.

2. The integrated support and wired rack of claim 1, wherein said right angle clamps are adjustable to permit raising and lowering of said cross support on said upright supports, and said wiring harness comprises a flexible jumper cable that has a multiple pin jumper connector on at least one end and a mating jumper connector on at least one of said supports, said jumper cable looping outside at least one of said clamps for connecting wires in said harness between said cross support and at least one of said upright supports.

3. The integrated support and wired rack of claim 1, said electrical input rack jacks each providing an input for one instrument and said output connector having multiple pins for connection to wires from all of said input rack jacks, whereby the signals for all the instruments on the rack can be carried by a multiple wire cable extending from a said output connector on said upright support.

4. The integrated support and wired rack of claim 1, wherein said right angle clamps are adjustable to permit raising and lowering of said cross support and wherein said wiring harness has a cross support segment and an upright support segment and further comprising a jumper cable having multiple pin jumper connectors on each end and mating jumper connectors mounted on said upright support having said output connector and on an adjacent end of said cross support for detachable connection between said segments of said wiring harness at one of said clamps.

5. The integrated support and wired rack of claim 1, further comprising a jack bracket mounted on an exterior of said cross support and having a plurality of input jacks installed thereon, an opening in a wall of said tublular cross support in registration with said jack bracket through which wires pass from said wiring harness to input jacks on said bracket.

6. The integrated support and wired rack of claim 1, further comprising an input output connector bracket mounted on an exterior of said at least one upright support adjacent said foot, said output connector and an additional plurality of instrument input jacks installed on said input/output connector bracket and said harness connecting said additional iput jack s to said output connector along with wires from said cross support mounted input jacks.

7. The integrated support and wired rack of claim 6, comprising a further additional plurality of input jacks mounted on said second upright support and connected by said wiring harness to said output connector on said first upright support via said cross support.

* * * * *